United States Patent [19]

Hoffend et al.

[11] Patent Number: 4,883,736

[45] Date of Patent: Nov. 28, 1989

[54] ELECTROPHOTOGRAPHIC TONER AND DEVELOPER COMPOSITIONS WITH POLYMERIC ALCOHOL WAXES

[75] Inventors: Thomas R. Hoffend, Webster; Don B. Jugle, Penfield, both of N.Y.

[73] Assignee: Xerox Corporation, Stamford, Conn.

[21] Appl. No.: 4,939

[22] Filed: Jan. 20, 1987

[51] Int. Cl.[4] ..... G03G 9/08

[52] U.S. Cl. ..... 430/110; 430/904; 524/275; 524/385; 106/31

[58] Field of Search ..... 430/110, 904; 524/275, 524/385

[56] References Cited

U.S. PATENT DOCUMENTS

| | | | |
|---|---|---|---|
| 3,655,374 | 4/1972 | Palermiti et al. | 430/110 |
| 3,983,045 | 9/1976 | Jugle et al. | 430/110 |
| 4,072,521 | 2/1978 | Scouten et al. | 430/110 |
| 4,251,616 | 2/1981 | Hendriks | 430/110 |
| 4,367,275 | 1/1983 | Aoki et al. | 430/99 |

FOREIGN PATENT DOCUMENTS 1442835 7/1976 United Kingdom .

OTHER PUBLICATIONS

Unilin Alcohols, Petrolite Corporation, SP 1040 (1985) Tulsa, Oklahoma.

*Primary Examiner*—J. David Welsh
*Attorney, Agent, or Firm*—E. O. Palazzo

[57] ABSTRACT

Disclosed is a toner composition comprised of resin particles, pigment particles, and a wax component comprised of polymeric alcohols of the formula $$Ch_3(CH_2)_nCH_2OH$$

wherein n is a number of from about 30 to about 300.

111 Claims, No Drawings

ELECTROPHOTOGRAPHIC TONER AND DEVELOPER COMPOSITIONS WITH POLYMERIC ALCOHOL WAXES

BACKGROUND OF THE INVENTION

This invention is generally directed to toner and developer compositions, and more specifically the present invention is directed to toner compositions, including magnetic, single component, and colored toner compositions with certain polymeric alcohol waxes. In one embodiment of the present invention, the toner compositions are comprised of resin particles, pigment particles, and waxes with hydroxyl functionality. There is also provided in accordance with the present invention positively charged toner compositions comprised of resin particles, pigment particles, waxes with hydroxyl functionality, and charge enhancing additives. Furthermore, there is provided in accordance with the present invention toner compositions wherein the polymeric alcohol waxes are present therein as external or internal additives. In addition, the present invention is directed to developer compositions comprised of the aforementioned toners, and carrier particles. Furthermore, in another embodiment of the present invention there are provided single component toner compositions comprised of resin particles, magnetic components such as magnetites, and waxes with hydroxyl functionality. The toner and developer compositions of the present invention are useful in electrostatographic imaging systems, especially those systems wherein blade cleaning of the photoconductive member is accomplished. Moreover, the toner and developer compositions of the present invention enable the photoconductive imaging member present in an imaging apparatus to function for extended time periods, for example, up to 100,000 cycles while simultaneously preventing the localized accumulation of undesirable toner debris thereon which can encompass sufficient areas of the photoconductive members to permit unwanted toner spots to be present on the final developed output copy. Further, the developer compositions of the present invention possess stable electrical properties for extended time periods, and with these compositions, for example, there is no substantial change in the triboelectrical charging values, and substantially no degradation in $A_t$ which is the product of the toner concentration +1 multiplied by the triboelectric charging value. Therefore, the units of measurement ($\mu$c percent/grams) for $A_t$ are$\pm$microcoulombs of charge on the toner particles multiplied by the percent toner concentration divided by grams of the toner particles that are separated from the developer composition by, for example, known blowing processes, which units are dependent on a number of factors inclusive of the composition of the carrier particles selected. Accordingly, thus the $A_t$ for the developer compositions of the present invention remains at, for example, from about 60 to about 80 for 300,000 developed images or copies while simultaneously maintaining high copy quality for each of the aforementioned images. Accordingly, there is permitted with the compositions of the present invention a prolonged charge exchange capability thereby contributing to a more stable development system requiring less complex control systems, and reduced maintenance of the imaging apparatus within which the compositions are incorporated. In addition, the aforementioned compositions provide for an increase in the latitudes over which a blade cleaning system can operate thereby enabling a more reliable and simpler apparatus.

By increased latitude, it is intended to refer to the achievement of obtaining an increase in the range of the load or force applied to the blade between a lower value wherein cleaning will fail, and an upper value wherein the blade undesirably bends causing the tip thereof to remain out of contact with the imaging member. Moreover, with increased latitude there can be selected a broader range of imaging member cleaning blade thicknesses, and various blade orientations with respect to the imaging member.

Developer and toner compositions with certain waxes therein are known. For example, there are disclosed in U.K. Patent Publication No. 1,442,835 toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. In addition, many patents disclose the use of metal salts of fatty acids for incorporation into toner compositions, such as U.S. Pat. No. 3,655,374. Also, it is known that the aforementioned toner compositions with metal salts of fatty acids can be selected for electrostatic imaging methods wherein blade cleaning of the photoreceptor is accomplished, reference Palmeriti et al. U.S. Pat. No. 3,635,704, issued January 18, 1972, the disclosure of which is totally incoporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxypolyethylene glycols; terephthalic acids; and the like, reference column 7, lines 13 to 43. There is no teaching, however, in any of these patents with respect to the toner compositions with the specific polymeric hydroxy waxes selected for the invention of the present application; and moreover, the toner and developer compositions of the '045 patent do not possess many of the advantages as illustrated herein with respect to the toner and developer compositions with the polymeric alcohol waxes therein, that is for example developer compositions of the '045 patent do not possess stable electrical properties in several imaging apparatuses, and with these compositions there is degradation in $A_t$ with extended imaging impressions, that is exceeding for example 100,000 developed images; nor, for example, does the incorporation of metal salts or metal salts of fatty acids such as zinc stearate; the addition of colloidal silicas, or mixtures thereof enable the elimination of toner spots on the final image copy with positively charged toner compositions, a disadvantage alleviated with the toner and developer compositions of the present application. Moreover, the polymeric alcohol waxes selected for the compositions of the present invention were not available prior to the issuance of the '045 patent, that is September 28, 1976.

Described in U.S. Pat. No. 4,367,275 are methods of preventing offsetting of electrostatic images of the toner composition to the fuser roll, which toner subsequently offsets to supporting substrates such as papers wherein there is selected toner compositions containing specific external lubricants including various waxes, see column 5, lines 32 to 45, which waxes are substantially different in their properties and characteristics than the polymeric alcohol waxes selected for the toner and developer compositions of the present invention; and moreover, the toner compositions of the present invention with the aforementioned polymeric alcohol additives posses advantages such as elimination of toner spotting not achievable with the toner and developer compositions of the '275 patent. In addition, the polymeric additives of the present invention were not known as of the issued date of the '275 patent, namely January 4, 1983.

Other references of interest which disclose the use of amides as toner additives include U.S. Pat. Nos. 4,072,521; 4,073,649; and 4,076,641. Furthermore, references of background interest are U.S. Pat. Nos. 3,165,420; 3,236,776; 4,145,300; 4,271,249; 4,556,624; 4,557,991; and 4,604,338.

Moreover, toner and developer compositions containing charge enhancing additives, especially additives which impart a positive charge to the toner resin, are well know. Thus, for example, there is described in U.S. Pat. No. 3,893,935 the use of certain quaternary ammonium salts as charge control agents for electrostatic toner compositions. There is also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there is illustrated in U.S. Pat. No. 4,338,390, the disclosure of which is totally incorporated herein by reference, developer and toner compositions having incorporated therein as charge enhancing additives organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride.

Other prior art disclosing positively charged toner compositions with charge enhancing additives include U.S. Pat. Nos. 3,944,493; 4,007,293; 4,079,014; and 4,394,430. Although the above described toner and developer compositions are useful for their intended purposes, there is a need for improved compositions. More specifically, there is a need for toner compositions, including single component compositions which possess advantages not achievable with the prior art compositions. There is also a need for toner compositions with certain waxes that are particularly useful in electrostatic imaging processes wherein blade cleaning is utilized for the removal of unwanted toner particles from the photoreceptor surface; and wherein there results no undesirable toner spots on the images resulting. In addition, there is a need for toner and developer compositions that maintain their triboelectrical characteristics for extended time periods, exceeding for example 100,000 developed images. In addition, there is a need for toner and developer compositions that simultaneously enable increased blade cleaning; eliminate toner spots; maintain stable electrical characteristics for extended time periods. Furthermore, there is a need for single component toners, and colored toners that possess many of the aforementioned characteristics. Also, there is a need for toner and developer compositions with certain toxicologically safe and economical waxes therein that allow the aforementioned advantages, and other advantages to be obtained.

SUMMARY OF THE INVENTION

It is an object of the present invention to provide toner and developer compositions which possess the above noted advantages.

Another object of the present invention resides in the provision of toner and developer compositions with stable triboelectrical characteristics for extended time periods.

In another object of the present invention there are provided toner and developer compositions that enable the substantial elimination of toner spots on documents generated in electrostatographic imaging systems.

Moreover, another object of the present invention relates to the provision of toner and developer compositions that permit improved blade cleaning of photoconductive surfaces.

In another object of the present invention there are provided toner and developer compositions that permit the design of blade cleaning systems with broader latitudes of functional design parameters as illustrated herein.

Also, in another object of the present invention there are provided toner and developer compositions wherein, for example, accumulations less than about 0.1 micrometer of the polymeric alcohol waxes results as determined by transmission electron microscopy (TEM) thereby avoiding any adverse effects on the electrical properties of the imaging member, and enabling images of high quality to be continuously reproduced.

Furthermore, there is a need for positively charged and negatively charged toner and developer compositions useful for the development of images present on positively or negatively charged imaging members.

Additionally, in yet another object of the present invention there are provided toner and developer compositions with certain waxes therein or thereon that enable images of excellent quality inclusive of acceptable resolutions with no toner spots, and that possess other advantages as illustrated herein.

In another object of the present invention there are provided positively charged toner compositions with certain waxes therein or thereon which are useful for causing the development of electrostatic latent images, including color images.

In yet another object of the present invention there are provided single component toner compositions with certain waxes therein or thereon.

In a further object of the present invention there are provided colored toner and developer compositions with certain waxes therein.

Additionally, in still another object of the present invention there are provided methods for the development of images, including colored images with no spots thereon in electrostatographic imaging systems.

These and other objects of the present invention are accomplished by providing developer compositions, and toner compositions comprised of resin particles, pigment particles, and certain waxes. More specifically, the present invention is directed to toner compositions comprised of resin particles, pigment particles inclusive of magnetites, and waxes with hydroxyl functionality. In one embodiment of the present invention there are provided toner compositions comprised of resin particles, pigment particles, and certain polymeric alcohol waxes, which waxes are available from Petrolite Corporation. Furthermore, there are provided in accordance with the present invention positively charged toner compositions comprised of resin particles, pigment particles, polymeric alcohol waxes, and charge enhancing additives. Another embodiment of the present invention is directed to developer compositions comprised of the aforementioned toners; and carrier particles.

In addition, in accordance with preferred embodiments of the present invention there are provided developer compositions comprised of toner compositions containing resin particles, particularly styrene butadiene resins, pigment particles such as magnetites, carbon blacks or mixtures thereof, polymeric hydroxy waxes available from Petrolite as detailed hereinafter, which waxes can be incorporated into the toner compositions as internal additives or may be present as external components; and optional charge enhancing additives, particularly for example distearyl dimethyl ammonium methyl sulfate, reference U.S. Pat. No. 4,560,635, the disclosure of which is totally incorporated herein by reference, and carrier particles. As preferred carrier components for the aforementioned compositions, there are selected steel or ferrite materials, particularly with a polymeric coating thereover including the coatings as illustrated in U.S. Ser. No. 751,922, entitled Developer Composition with Specific Carrier Particles, the disclosure of which is totally incorporated herein by reference. One particularly preferred coating illustrated in the aforementioned copending application is comprised of a copolymer of vinyl chloride and trifluorochloroethylene with conductive substances dispersed in the polymeric coating inclusive of, for example, carbon black. One embodiment disclosed in the aforementioned copending application is a developer composition comprised of styrene butadiene copolymer resin particles, and charge enhancing additives selected from the group consisting of alkyl pyridinium halides, ammonium sulfates, and organic sulfate or sulfonate compositions; and carrier particles comprised of a core with a coating of vinyl copolymers, or vinyl homopolymers.

Illustrative examples of suitable toner resins selected for the toner and developer compositions of the present invention, and present in various effective amounts such as, for example, from about 70 percent by weight to about 95 percent by weight, include polyesters, polyamides, epoxy resins, polyurethanes, polyolefins, vinyl resins and polymeric esterification products of a dicarboxylic acid and a diol comprising a diphenol. Various suitable vinyl resins may be selected as the toner resin including homopolymers or copolymers of two or more vinyl monomers. Typical vinyl monomeric units include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; styrene butadiene copolymers, especially styrene butadiene copolymers prepared by a suspension polymerization process reference, U.S. Pat. No. 4,558,108, the disclosure of which is totally incorporated herein by reference; and mixtures thereof.

As one preferred toner resin there can be selected the esterification products of a dicarboxylic acid and a diol comprising a diphenol, which components are illustrated in U.S. Pat. No. 3,590,000, the disclosure of which is totally incorporated herein by reference. Other preferred toner resins included styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as Pliolites® from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol.

Numerous well known suitable pigments can be selected as the colorant for the toner particles including, for example, carbon black, nigrosine dye, aniline blue, phthalocyanine derivatives, magnetites and mixtures thereof. The pigment, which is preferably carbon black, should be present in a sufficient amount to render the toner composition colored thereby permitting the formation of a clearly visible image. Generally, the pigment particles are present in amounts of from about 3 percent by weight to about 20 percent by weight, based on the total weight of the toner composition, however, lesser or greater amounts of pigment particles can be selected providing the objectives of the present invention are achieved.

When the pigment particles are comprised of magnetites, including those commercially available as Mapico Black®, they are present in the toner composition in an amount of from about 10 percent by weight to about 70 percent by weight, and preferably in an amount of from about 10 percent by weight to about 30 percent by weight. Alternatively, there can be selected as pigment particles mixtures of carbon black or equivalent pigments and magnetites, which mixtures for example contain from about 6 percent to about 70 percent by weight of magnetite, and from about 2 percent to about 15 percent by weight of carbon black. Particularly preferred as pigments are magnetites as they enable, for example, images with no toner spots for extended time periods exceeding the development of 100,000 images, which corresponds to about 400,000 imaging cycles for a panel containing four imaging members.

Also embraced within the scope of the present invention are colored toner compositions containing as pigments or colorants magenta, cyan, and/or yellow particles, as well as mixtures thereof. More specifically, with regard to the generation of color images utilizing the toner and developer compositions of the present invention, illustrative examples of magenta materials that may be selected include, for example, 2,9-dimethyl-substituted quinacridone and anthraquinone dye identified in the color index as CI 60710, CI Dispersed Red 15, a diazo dye identified in the color index as CI 26050, CI Solvent Red 10, Lithol Scarlett, Hostaperm, and the like. Illustrative examples of cyan materials that may be used as pigments include copper tetra-4(octadecyl sulfonamido) phthalocyanine, X-copper phthalocyanine pigment listed in the color index as CI 74160, CI Pigment Blue, and Anthrathrene Blue, identified in the color index as CI 69810, Special Blue X-2137, Sudan Blue, and the like; while illustrative examples of yellow pigments that may be selected include diarylide yellow 3,3-dichlorobenzidene acetoacetanilides, a monazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and the like. These pigments are generally present in the toner composition in an amount of from about 2 weight percent to about 15 weight percent based on the weight of the toner resin particles.

Illustrative examples of optional charge enhancing additives present in various effective amounts, such as for example from about 0.1 to about 20 percent by weight, include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives providing the objectives of the present invention are accomplished; and the like.

With further respect to the toner and developer compositions of the present invention, an important component present therein that enables many of the advantages illustrated herein to be obtained is the linear polymeric alcohol comprised of a fully saturated hydrocarbon backbone with at least about 80 percent of the polymeric chains terminated at one chain end with a hydroxyl group, which alcohol is represented by the following formula:

$$CH_3(CH_2)_nCH_2OH$$

wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in a preferred embodiment of the present invention the polymeric alcohols selected have a number average molecular weight as determined by gas chromatography of from about greater than 450 to about 1,400, and preferably of from about 475 to about 750. In addition, the aforementioned polymeric alcohols are present in the toner and developer compositions illustrated herein in various effective amounts, and can be added as uniformly dispersed internal, or as finely divided uniformly dispersed external additives. More specifically, the polymeric alcohols are present in an amount of from about 0.05 percent to about 20 percent by weight. Therefore, for example, as internal additives the polymeric alcohols are present in an amount of from about 0.5 percent by weight to about 20 percent by weight, while as external additives the polymeric alcohols are present in an amount of from about 0.05 percent by weight to slightly less than about 5 percent by weight. Toner and developer compositions with the waxes present internally are formulated by initially blending the toner resin particles, pigment particles, and polymeric alcohols, and other optional components. In contrast, when the polymeric alcohols are present as external additives, the toner composition is initially formulated comprised of, for example, resin particles and pigment particles; and subsequently there is added thereto finely divided polymeric alcohols.

Although it is not desirable to be limited by theory, it is believed that the aforementioned linear polymeric alcohols possess very narrow polydispersity, that is the ratio of Mw/Mn is equal to or less than about 1.1 in one preferred embodiment; and moreover, these alcohols possess high crystallinity with a density of about 0.985. By high crystallinity is meant that the linear polymeric alcohol molecular chains possess a high degree of molecular order in their solid state molecular structure; and also possess zero to very few defects in this ordered molecular structure, reference for example the text Macromolecule Structure and Properties, Vol. 1, authored by Hans Georg Elias (1984), particularly Chapter 5, pages 151 to 154. Accordingly, it is believed that the polymeric waxes selected are substantially different than the waxes illustrated in the prior art primarily because of the advantages achieved with the toner and developer compositions containing these waxes, which advantages are not obtainable with the wax toner compositions of the prior art; and moreover, the specific waxes of the present invention encompassed by the formula illustrated herein possess properties that are unique for polymeric waxes inclusive of substantially complete saturation, high linearity, crystallinity, narrow molecular weight distributions, and primary alcohol functionality. In addition, the primary alcohol waxes of the present invention possess the appropriate hardness and toughness properties enabling the resulting toner and developer compositions to be readily attritable to fine particle sizes of less than, for example, about 15 micrometers average diameter.

Moreover, the polymeric alcohols of the present invention are substantially different than the fatty alcohols of the prior art including, for example, stearyl alcohol which has a hydroxy number much higher than the polymeric alcohols, that is a value of from about 200 to about 212, as compared to a hydroxy value of from about 66 to about 110 for the polymeric alcohols of the present invention; an iodine value of a maximum of 2 which indicates a small amount of unsaturation in the hydrocarbon chain of the alcohol whereas the polymeric alcohols of the present invention are believed to be fully saturated, that is there is no unsaturation present; a melting point of 50° to 60° C. which is much lower than the melting point of the polymeric alcohols of from about 87° C. to about 110° C.; and a solubility at 25° C. in many solvents while the polymeric alcohols selected for the present invention are generally soluble only at elevated temperatures, that is greater than 50° C.

With further respect to the toner and developer compositions of the present invention, particularly the advantages achievable thereby as further demonstrated in the working examples, by spots as mentioned herein is meant a spot of toner on the imaging member. The aforementioned spot can retain electrostatic charge independent of the exposure of the imaging member permitting it to undesirably attract toner particles which are then transferred to the final image copy yielding an unwanted spot or an accumulation of spots. Accordingly, spots are undesirable, particularly when more than one spot results on the final image which is usually the situation with the waxes of the prior art wherein, for example, hundreds of spots are formulated with a length of from about 4 to about 5 millimeters, and a width of 0.5 millimeters as eventually these spots will result in images of very poor resolution, unwanted background, and other undesirable copy quality characteristics including unacceptable edge definition.

Illustrative examples of carrier particles that can be selected for mixing with the toner compositions of the present invention include those particles that are capable of triboelectrically obtaining a charge of opposite polarity to that of the toner particles. Accordingly, the carrier particles of the present invention can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include granular zircon, granular silicon, glass, steel, nickel, iron, ferrites, silicon dioxide, and the like. Additionally, there can be selected as carrier particles nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover several of which are illustrated, for example, in U.S. Ser. No. 751,922 relating to developer compositions with certain carrier particles, the disclosure of which is totally incorporated herein by reference. More specifically, there are illustrated in the aforementioned copending application carrier particles comprised of a core with a coating thereover of vinyl polymers, or vinyl homopolymers. Examples of specific carriers illustrated in the copending application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride; and trichlorofluoroethylene; and other known coatings. There can also be selected as carriers components comprised of a core with a double polymer coating thereover, reference U.S. Ser. No. 793,042, entitled Developer Composition With Coated Carrier Particles, the disclosure of which is totally incorporated herein by reference. More specifically, there is detailed in this application a process for the preparation of carrier particles with substantially stable conductivity parameters which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, thus allowing these particles to possess sufficient density and inertia to avoid adherence to the electrostatic images during the developement process. The carrier particles can be mixed with the toner particles in various suitable combinations, however, best results are obtained when about 1 to about 5 parts per toner to about 10 parts to about 200 parts by weight of carrier are mixed.

The aforementioned toner compositions of the present invention possess excellent electrical properties, thus for example, the $A_t$ as illustrated hereinbefore with the toner compositions that contain no additives therein is greater than zero and less than about 40; however, for those toner compositions with charge enhancing additive therein the $A_t$ is greater than 30 and less than about 200. With further respect to the aforementioned $A_t$, it is of course to be appreciated that these values depend on the number of charcteristics including the electrostatographic components selected, the chemical constituents, the concentrations thereof, the specific carrier cores and coatings utilized; and the like. Accordingly, other $A_t$ values may be acceptable providing the objectives of the present invention are achievable.

The toner compositions of the present invention can be prepared by a number of known methods, including mechanical blending and melt blending the toner resin particles, pigment particles or colorants, and polymeric alcohols followed by mechanical attrition. Other methods include those well known in the art such as spray drying, mechanical dispersion, melt dispersion, dispersion polymerization, and suspension polymerization. In one dispersion polymerization method, a solvent dispersion of the resin particles, the pigment particles, polymeric alcohols, and charge enhancing additive are spray dried under controlled conditions to result in the desired product. With further respect to the present invention, the polymeric alcohols are preferably added as external additives, that is the toner compositions are first prepared, which compositions are comprised of, for example resin particles and pigment particles; and subsequently there is added thereto the polymeric alcohol, preferably in a finely divided form wax. Alternatively, however, as indicated herein the wax may be incorporated as an internal additive by formulating the toner composition with a process that comprises the mixing and melt blending of resin particles, pigment particles, and wax.

With further respect to the present invention and the advantages illustrated herein, they are preferably obtained by preparing the toner compositions in a manner that the wax is provided as an external component especially in an amount of from about 0.05 to about 5 percent by weight. Moreover, the resulting toner particles with wax therein are generally of an average diameter of from about 1 to about 50 micrometers.

In addition, the toner and developer compositions of the present invention may be selected for use in developing images in electrostatographic imaging systems, containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253; and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines and vanadyl phthalocyanines, while examples of charge transport layers include the aryl amines as disclosed in U.S. Pat. No. 4,265,990. Other photoresponsive devices useful in the present invention include 4-dimethylaminobenzylidene, 2-benzylideneamino-carbazole; 4-dimethamino-benzylidene; (2-nitro-benzylidene)-p-bromoaniline; 2,4-diphenyl-quazoline; 1,2,4-triazine; 1,5-diphenyl-3-methyl pyrazoline; 2-(4'-dimethyl-amino phenyl)-benzoaxzole; 3-aminocarbazole; hydrazone derivatives; polyvinyl carbazoletrinitrofluorenone charge transfer complex; and mixtures thereof. Moreover, there can be selected as photoconductors hydrogenated amorphous silicon; and as photogenerating pigments squaraines, perylenes; and the like.

Moreover, the toner and developer compositions of the present invention are particularly useful with electrostatographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone. In one embodiment, this is accomplished by bringing a transporting member, such as a development roller, and a tensioned deflected flexible imaging member into close proximity, that is a distance of from about 0.05 millimeter to about 1.5 millimeters, and preferably from about 0.4 millimeter to about 1.0 millimeter in the present of a high electric field, and causing such members to move at relative speeds. There is illustrated in the aforementioned '970 patent an electrostatographic imaging apparatus comprised of an imaging means, a charging means, an exposure means, a development means, and a fixing means, the improvement residing in the development means comprising in operative relationship a tensioned deflected flexible imaging means; a transporting means; a development zone situated between the imaging means and the transporting means; the development zone containing therein electrically insulating magnetic carrier particles, means for causing the flexible imaging means to move at a speed of from about 5 cm/sec to about 50 cm/sec, means for causing the transporting means to move at a speed of from about 6 cm/sec to about 100 cm/sec, the means for imaging and the means for transporting moving at different speeds; and the means for imaging and the means for transporting having a distance therebetween of from about 0.05 millimeter to about 1.5 millimeters.

An especially preferred developer composition of the present invention is comprised of a toner composition with styrene butadiene resin particles (91/9), about 16 percent by weight of magnetite, about 3 percent by weight of carbon black, about 1.0 percent by weight of the charge enhancing additive distearyl dimethyl ammonium methyl sulfate, and as an external additive about 0.30 percent by weight of the polymeric alcohol illustrated herein with a number average molecular weight of about 700, and carrier particles comprised of a steel core with a coating thereover of a polymer of, for example, a vinyl chloride/trichlorofluoroethylene copolymer available as FPC 461, which coating has dispersed therein carbon black particles.

The following examples are being submitted to further define various species of the present invention. These examples are intended to illustrate and not limit the scope of the present invention. Also, parts and percentages are by weight unless otherwise indicated.

With respect to image quality, a number of different imaging characteristics are associated therewith, thus high image quality includes, but is not limited to, for example, the absence of substantially no background deposits on the resulting image copy; acceptable edge definition; excellent solid area density; line width; and halftone reproduction; and further, the images were nongrainy as determined by visual observation.

EXAMPLE I

There was prepared by melt blending, followed by mechanical attrition, a toner composition comprised of 80 percent by weight of a styrene butadiene resin with 91 percent by weight of styrene and 9 percent by weight of butadiene, 3 percent by weight of Regal® 330 carbon black, 16 percent by weight of Mapico Black®, and 1 percent by weight of the charge enhancing additive distearyl dimethyl ammonium methyl sulfate. Subsequently, there was prepared a developer composition by admixing the aforementioned formulated toner composition at a 4.5 percent toner concentration, that is 4.5 parts by weight of toner per 100 parts by weight of carrier, which carrier was comprised of a steel core with a coating thereover of a vinyl chloride trichlorofluoroethylene copolymer with carbon black particles dispersed therein.

Thereafter, the formulated developer composition was incorporated into an electrostatographic imaging device with a toner transporting means, a toner metering charging means, and a development zone as illustrated in U.S. Pat. No. 4,394,429; and wherein the imaging member is comprised of an aluminum supporting substrate, a photogenerating layer of trigonal selenium, and a charge transport layer thereover of the aryl amine N,N'-diphenyl-N,N'-bis(3-methylphenyl) 1,1'-biphenyl-4,4'-diamine, 50 percent by weight, dispersed in 50 percent by weight of the polycarbonate resin available as Makrolon®, reference U.S. Pat. No. 4,265,990, the disclosure of which is totally incorporated herein by reference.

There were obtained in the aforementioned imaging fixture images of acceptable quality for about 20,000 developed images, however, subsequently the images began to deteriorate in that toner spots began to form on the resulting developed images present on the paper substrates. Eventually, a number of toner spots formulated, which spots were noted by visual observation, and appeared in the unimaged areas of the developed image copy obtained. The frequency and size of the spots per copy increased with an increase in the number of developed images formed.

Moreover, this developer composition had a developer life of about 75,000 impressions, that is the $A_t$ value was from about −90 to about −100, and decayed to an unacceptable level of from about −40 to about −50 after 75,000 printed copies.

Also, as determined by visual observation, there were obtained grainy images after 75,000 developed images.

EXAMPLE II

A toner and developer composition was prepared by repeating the procedure of Example I with the exception that there was incorporated as an external component 0.27 weight percent of a linear polymeric alcohol, available from Petrolite Corporation, of the formula as illustrated herein with a number average molecular weight of about 700, that is where n is a number of about 48, as determined by gas chromotagraphy, and with an average particle size diameter of 8 micrometers.

The prepared developer composition was then incorporated into the same electrostatographic imaging device of Example I, and there resulted images of excellent quality, for example, with no background deposits, and no toner spots were observed for 300,000 developed images; and further, the $A_t$ which was initially about −80 decayed to −70 μc percent/gram after 40,000 developed images, and remained at −70 μc percent/gram for 300,000 developed images at which time the test was terminated.

EXAMPLE III

A toner and developer composition was prepared by repeating the procedure of Example II with the exception that there was selected 0.2 percent by weight of the polymeric alcohol, available from Petrolite Corporation, of the formula as illustrated herein with a number average molecular weight of about 425, and subsequent to incorporation into the electrostatographic imaging device. The $A_t$ which was initially about −80 μc percent/gram, decayed to an undesirable −25 μc percent/gram after 21,000 developed images. There was an absence of toner spots on the developed images.

EXAMPLE IV

A toner and developer composition was prepared by repeating the procedure of Example II with the exception that there was selected 0.05 percent by weight of the polymeric alcohol, and subsequent to imaging in the electrostatographic imaging device no spots were observed until 87,000 developed images. The $A_t$ was initially at about −80 μc percent/gram, and at the termination of the test at 100,000 developed images, the $A_t$ was −75 μc percent/gram.

Additionally, 87,000 developed images of excellent quality were obtained similar to those that resulted with the toner and developer composition of Example II.

EXAMPLE V

A toner and developer composition was prepared by repeating the procedure of Example II with the exception that there was selected 0.5 percent by weight of the polymeric alcohol with a number average molecular weight of 700, available from Petrolite Corporation, and substantially similar results were obtained.

More specifically, with the aforementioned toner and developer composition no spots were observable after 100,000 developed images, and further the $A_t$ was −75 μc percent/gram at the termination of the test after starting with the initial $A_t$ being about −80 μc percent/gram.

In addition, images of excellent quality were obtained and no grainy images resulted as was determined by visual observation for 100,000 developed image copies, nor was there any granularity as determined by a scanning microdensitometer.

Other modifications of the present invention may occur to those skilled in the art subsequent to a review of the present application. The aforementioned modifications, including equivalents thereof are intended to be included within the scope of the present invention.

What is claimed is:

1. A toner composition comprised of resin particles, pigment particles, and a wax component present in an amount of from about 0.05 percent by weight to about 20 percent by weight and comprised of polymeric alcohols of the formula $$CH_3(CH_2)_nCH_2OH$$

wherein n is a number of from about 30 to about 300, which composition prevents cometing.

2. A toner composition in accordance with claim 1 wherein n is a number of from about 30 to about 50.

3. A toner composition in accordance with claim 1 wherein the polymeric alcohol wax has a number average molecular weight of from about 475 to about 1,400.

4. A toner composition in accordance with claim 1 wherein the polymeric alcohol wax has a number average molecular weight of from about 475 to about 750.

5. A toner composition in accordance with claim 1 wherein the polymeric alcohol wax is present as an external component.

6. A toner composition in accordance with claim 1 wherein the resin particles are selected from the group consisting of polyesters, styrene butadiene copolymers, styrene acrylate copolymers, and styrene methacrylate copolymers.

7. A toner composition in accordance with claim 6 wherein the polyester results from the condensation reaction of dimethylterephthalate, 1,2-propanediol, 1,3-butanediol, and pentaerythritol; or wherein the polyester results from the condensation reaction of dimethylterephthalate, 1,2-propanediol, diethylene glycol, and pentaerythritol.

8. A toner composition in accordance with claim 6 wherein the styrene butadiene copolymer contains 91 percent by weight of styrene, and 9 percent by weight of butadiene.

9. A toner composition in accordance with claim 6 wherein there is selected a suspension polymerized styrene butadiene.

10. A toner composition in accordance with claim 1 wherein the pigment particles are carbon black.

11. A toner composition in accordance with claim 1 wherein the pigment particles are magnetite.

12. A toner composition in accordance with claim 1 wherein the pigment particles are comprised of a mixture of carbon black and magnetites.

13. A toner composition in accordance with claim 1 wherein the pigment particles are selected from the group consisting of magenta, cyan, yellow, and mixtures thereof.

14. A toner composition in accordance with claim 1 wherein the polymeric alcohols are present as external additives in an amount of from about 0.05 percent by weight to about less than 5 percent by weight.

15. A toner composition in accordance with claim 1 containing therein a charge enhancing additive.

16. A toner composition in accordance with claim 15 wherein the charge enhancing additive is selected from the group consisting of distearyl dimethyl ammonium methyl sulfate, cetyl pyridinium halides, and stearyl phenethyl dimethyl ammonium tosylate.

17. A toner composition in accordance with claim 15 wherein the charge enhancing additive is distearyl dimethyl ammonium methyl sulfate.

18. A toner composition in accordance with claim 15 wherein the pigment particles are comprised of a mixture of carbon black and magnetite.

19. A toner composition in accordance with claim 18 wherein the mixture contains from about 6 percent by weight to about 70 percent by weight of magnetite, and from about 2 percent by weight to about 15 percent by weight of carbon black.

20. A toner composition in accordance with claim 15 wherein the pigment particles are selected from the group consisting of magenta, cyan, yellow and mixtures thereof.

21. A toner composition in accordance with claim 15 wherein the resin particles are comprised of components selected from polyesters, styrene butadiene copolymers, styrene acrylate copolymers, and styrene methacrylate copolymers.

22. A toner composition in accordance with claim 15 wherein the resin particles are comprised of a styrene butadiene copolymer containing 91 percent by weight of styrene and 9 percent by weight of a butadiene; or 87 percent by weight of styrene and 13 percent by weight of butadiene.

23. A toner composition in accordance with claim 15 wherein the polymeric alcohol has a number average molecular weight of from about 475 to about 1,400.

24. A toner composition in accordance with claim 15 wherein the polymeric alcohol wax is present as an external additive.

25. A developer composition comprised of the toner composition of claim 1, and carrier particles.

26. A developer composition comprised of the toner composition of claim 15, and carrier particles.

27. A developer composition in accordance with claim 25 wherein the carrier particles are comprised of a core with a polymeric coating thereover.

28. A developer composition in accordance with claim 26 wherein the carrier particles are comprised of a core with a polymeric coating thereover.

29. A developer composition in accordance with claim 26 wherein the carrier particles are comprised of a steel or a ferrite core with a coating thereover selected from the group consisting of polychlorotrifluoroethylene-co-vinylchloride copolymer, a polyvinylidene fluoropolymer, or a terpolymer of styrene, methacrylate, and an organo silane, fluorinated ethylene-propylene copolymers, and polytetrafluoroethylene.

30. A developer composition in accordance with claim 27 wherein the carrier particles are comprised of a steel or a ferrite core with a coating thereover selected from the group consisting of polychlorotrifluoroethylene-co-vinylchloride copolymer, a polyvinylidene fluoropolymer, or a terpolymer of styrene, methacrylate, and an organo silane, fluorinated ethylene-propylene copolymers, and polytetrafluoroethylene.

31. A developer composition in accordance with claim 25 wherein the polymeric alcohol wax selected has a number average molecular weight of from about 475 to about 1,400.

32. A developer composition in accordance with claim 26 wherein the polymeric alcohol wax has a molecular weight average of from about 475 to about 1,400.

33. A developer composition in accordance with claim 26 wherein the resin particles are selected from the group consisting of polyesters, styrene butadiene copolymers, styrene acrylate copolymers, and styrene methacrylate copolymers.

34. A developer composition in accordance with claim 33 wherein the polyester results from the condensation reaction of dimethylterephthalate, 1,3-butanediol, 1,2-propanediol, and pentaerythritol.

35. A developer composition in accordance with claim 33 wherein the styrene butadiene copolymer contains 91 percent by weight of styrene, and 9 percent by weight of butadiene.

36. A developer composition in accordance with claim 33 wherein there is selected a suspension polymerized styrene butadiene.

37. A developer composition in accordance with claim 26 wherein the pigment particles are comprised of a mixture of carbon black and magnetites.

38. A developer composition in accordance with claim 37 wherein the mixture contains from about 6 percent by weight to about 70 percent by weight of magnetite, and from about 2 percent by weight to about 15 percent by weight of carbon black.

39. A developer composition in accordance with claim 26 wherein the pigment particles are selected from the group consisting of magenta, cyan, yellow, and mixtures thereof.

40. A developer composition in accordance with claim 26 wherein the polymeric alcohol wax is present as an external additive.

41. A developer composition in accordance with claim 26 wherein the charge enhancing additive is selected from the group consisting of distearyl dimethyl ammonium methyl sulfate, cetyl pyridinium halides, and stearyl phenethyl dimethyl ammonium tosylate.

42. A developer composition in accordance with claim 27 wherein the resin particles are selected from the group consisting of polyesters, styrene butadiene copolymers, styrene acrylate copolymers, and styrene methacrylate copolymers.

43. A developer composition in accordance with claim 42 wherein the polyester results from the condensation reaction of dimethylterephthalate, 1,3-butanediol, 1,2-propanediol, and pentaerythritol.

44. A developer composition in accordance with claim 42 wherein the styrene butadiene copolymer contains 91 percent by weight of styrene, and 9 percent by weight of butadiene.

45. A developer composition in accordance with claim 42 wherein there is selected a suspension polymerized styrene butadiene.

46. A developer composition in accordance with claim 27 wherein the pigment particles are comprised of a mixture of carbon black and magnetites.

47. A developer composition in accordance with claim 46 wherein the mixture contains from about 6 percent by weight to about 70 percent by weight of magnetite, and from about 2 percent by weight to about 15 percent by weight of carbon black.

48. A developer composition in accordance with claim 27 wherein the pigment particles are selected from the group consisting of magenta, cyan, yellow, and mixtures thereof.

49. A developer composition in accordance with claim 27 wherein the polymeric alcohol wax is present as an external additive.

50. A developer composition in accordance with claim 27 wherein the charge enhancing additive is selected from the group consisting of distearyl dimethyl ammonium methyl sulfate, cetyl pyridinium halides, and stearyl phenethyl dimethyl ammonium tosylate.

51. A method for obtaining images which comprises generating an electrostatic latent image on a photoconductive imaging member, subsequently affecting development of this image with the toner composition of claim 1, thereafter transferring the image to a permanent substrate, and permanently affixing the image thereto.

52. A method for obtaining images which comprises generating an electrostatic latent image on a photoconductive imaging member, subsequently affecting development of this image with the toner composition of claim 15, thereafter transferring the image to a permanent substrate, and permanently affixing the image thereto.

53. A method for obtaining images which comprises generating an electrostatic latent image on a photoconductive imaging member, subsequently affecting development of this image with the developer composition of claim 25, thereafter transferring the image to a permanent substrate, and permanently affixing the image thereto.

54. A method of imaging in accordance with claim 51 wherein there results images with no toner spots thereon.

55. A method of imaging in accordance with claim 52 wherein there results images with no toner spots thereon.

56. A method of imaging in accordance with claim 53 wherein there results images with no toner spots thereon.

57. A method of imaging in accordance with claim 51 wherein a blade means is selected for accomplishing cleaning of the photoresponsive imaging member.

58. A toner composition in accordance with claim 12 wherein the mixture contains from about 6 percent by weight of magnetite to about 70 percent by weight of magnetite, and from about 3 percent by weight to about 15 percent by weight of carbon black.

59. A toner composition in accordance with claim 15 wherein the wax is present in an amount of from about 0.05 percent by weight to about 20 percent by weight.

60. A toner composition in accordance with claim 15 wherein the wax has a number average molecular weight of from about 475 to about 700.

61. A toner composition in accordance with claim 24 wherein the wax is present in an amount of from about 0.05 percent by weight to about less than 5 percent by weight.

62. A developer in accordance with claim 25 wherein the polymeric alcohol wax has a number average molecular weight of from about 475 to about 750.

63. A developer in accordance with claim 26 wherein the polymeric alcohol wax has a number average molecular weight of from about 475 to about 750.

64. A developer in accordance with claim 27 wherein the polymeric alcohol wax has a number average molecular weight of from about 475 to about 750.

65. A developer in accordance with claim 28 wherein the polymeric alcohol wax has a number average molecular weight of from about 475 to about 750.

66. A method for obtaining images which comprises generating an electrostatic latent image on a photoconductive imaging member, subsequently affecting development of this image with the developer composition of claim 26, thereafter transferring the image to a permanent substrate, and permanently affixing the image thereto.

67. A method for obtaining images which comprises generating an electrostatic latent image on a photoconductive imaging member, subsequently affecting development of this image with the developer composition of claim 27, thereafter transferring the image to a permanent substrate, and permanently affixing the image thereto.

68. A method of imaging in accordance with claim 66 wherein there results images with no toner spots thereon.

69. A method of imaging in accordance with claim 67 wherein there results images with no toner spots thereon.

70. A method of imaging in accordance with claim 66 wherein a blade means is selected for accomplishing cleaning of the photoresponsive imaging member.

71. A method of imaging in accordance with claim 67 wherein a blade means is selected for accomplishing cleaning of the photoresponsive imaging member.

72. A toner composition in accordance with claim 21 wherein the polyester results from the condensation reaction of dimethylterephthalate, 1,2-propanediol, 1,3-butanediol, and pentaerythritol; or when the polyester results from the condensation reaction of dimethylterephthalate, 1,2-propanediol, diethylene glycol, and pentaerythritol.

73. A toner composition comprised of from about 70 percent by weight to about 95 percent by weight of resin particles; and dispersed therein pigment particles in an amount of from about 3 percent by weight to about 20 percent by weight, and a wax component present in an amount of from about 0.05 percent by weight to about 20 percent by weight and comprised of linear polymeric alcohols with from about 80 to about 85 percent of the polymeric chains terminated at one chain end with a hydroxyl group, and of the formula $$CH_3(CH_2)_nCH_2OH$$

wherein n is a number of from about 30 to about 300, which composition prevents or minimizes cometing.

74. A toner composition in accordance with claim 73 wherein the polymeric alcohol is present as an external additive in an amount of from about 0.05 to about 5 percent by weight.

75. A toner composition in accordance with claim 73 wherein the polymeric alcohol is present as an external additive in an amount of 0.2 or 0.27 percent by weight.

76. A toner composition in accordance with claim 73 wherein the polymeric alcohol is present as an internal additive in an amount of from about 0.5 to about 20 percent by weight.

77. A toner composition in accordance with claim 73 containing therein charge enhancing additive components.

78. A toner composition in accordance with claim 73 wherein the polymeric alcohols possess a hydroxy number of from about 66 to about 110.

79. A toner composition in accordance with claim 73 wherein the polymeric alcohols are saturated.

80. A toner composition in accordance with claim 73 wherein the melting point of the polymeric alcohol is from about 87° C. to about 110° C.

81. A toner composition in accordance with claim 73 wherein the polymeric alcohol is of the formulas $C_{48}H_{97}OH$, or $C_{50}H_{101}OH$.

82. A developer composition comprised of the toner composition of claim 73 and carrier particles.

83. A developer composition in accordance with claim 82 wherein the carrier particles include a coating thereover.

84. A developer composition in accordance with claim 83 wherein the coating is selected from the group consisting of polychlorotrifluoroethylene-co-vinylchloride copolymer; a polyvinylidene fluoropolymer; a terpolymer of styrene, methacrylate, and an organo silane; fluorinated ethylene-propylene copolymers; polytetrafluoroethylene; and a vinyl chloride trichorofluoroethylene copolymer, which coating has carbon black particles dispersed therein.

85. A developer composition in accordance with claim 84 wherein the core of the carrier particles is comprised of steel.

86. A method of imaging in a continuous manner which comprises (1) generating an electrostatic latent image on a photoconductive imaging member; (2) affecting development of the image with the toner composition of claims 1, 74 or 90; (3) transferring the developed image to a permanent substrate; (4) permanently affixing the image thereto; and (5) thereafter repeating the aforementioned steps (1) to (4).

87. A method of imaging in accordance with claim 86 wherein there results images with no toner spots thereon.

88. A method of imaging in accordance with claim 86 wherein a blade means is selected for accomplishing cleaning of the photoresponsive imaging member.

89. A toner composition in accordance with claim 1 wherein from about 80 to about 85 percent of the polymeric chains of the alcohol are terminated at one chain end with a hydroxyl group.

90. A toner composition in accordance with claim 89 wherein the polymeric alcohol is present as an external additive in an amount of from about 0.05 to about 5 percent by weight.

91. A toner composition in accordance with claim 90 wherein the polymeric alcohol is present as an internal additive in an amount of 0.2 or 0.27 percent by weight.

92. A toner composition in accordance with claim 90 wherein the polymeric alcohols possess a hydroxy number of from about 66 to about 110.

93. A toner composition in accordance with claim 90 wherein the melting point of the polymeric alcohol is from about 87° C. to about 110° C.

94. A toner composition in accordance with claim 1 wherein the polymeric alcohols possess a hydroxy number of from about 66 to about 110.

95. A toner composition in accordance with claim 1 wherein the melting point of the polymeric alcohol is from about 87° C. to about 110° C.

96. A toner composition in accordance with claim 1 wherein the polymeric alcohol is present as an external additive in an amount of 0.2 or 0.27 percent by weight.

97. A toner composition in accordance with claim 1 wherein the polymeric alcohols are $C_{48}H_{97}OH$, or $C_{50}H_{101}OH$.

98. A toner composition in accordance with claim 1 wherein the polymeric alcohol is UNILIN® 425.

99. A toner composition in accordance with claim 1 wherein the polymeric alcohol is UNILIN 550 or UNILIN 700.

100. A developer composition comprised of the toner composition of claim 89 and carrier particles.

101. A toner composition in accordance with claim 1 wherein the pigment particles are dispersed in the resin particles.

102. A toner composition in accordance with claim 89 wherein the pigment particles are dispersed in the resin particle.

103. A toner composition comprised of a mixture containing from about 70 percent by weight to about 95 percent by weight of resin particles; dispersed therein pigment particles in an amount of from about 3 percent by weight to about 20 percent by weight; and a wax component present in an amount of from about 0.05 percent by weight to about 20 percent by weight and comprised of linear polymeric alcohols of the formula $$CH_3(CH_2)_nCH_2OH$$

wherein n is a number of from about 30 to about 300, which composition prevents the localized accumulation or cometing of undesirable toner debris on a photoconductive imaging member.

104. A toner composition in accordance with claim 103 wherein the polymeric alcohol contains from about 80 to about 85 percent of polymeric chains terminated at one chain end with a hydroxyl group.

105. A toner composition in accordance with claim 103 wherein the wax component is present as an external additive in an amount of from about 0.05 to about 5 percent by weight, or as an internal additive in an amount of from about 0.05 to about 20 weight percent.

106. A toner composition in accordance with claim 103 wherein the resin particles are present in an amount of 80 percent by weight, the pigment particles are comprised of a mixture of carbon black present in an amount of 3 percent by weight, and magnetite present in an amount of 16 percent by weight, and the wax component is present as an external additive in an amount of 0.27 percent by weight.

107. A toner composition in accordance with claim 106 wherein the toner contains a charge enhancing additive present in an amount of about 1 percent by weight.

108. A toner composition in accordance with claim 107 wherein the charge enhancing additive is distearyl dimethyl ammonium methyl sulfate.

109. A toner composition in accordance with claim 1 wherein the wax is present as an external component enabling said composition to prevent the localized accumulation or cometing of undesirable toner debris on a photoconductive imaging member.

110. A toner composition in accordance with claim 1 wherein the polymeric alcohols are present in an amount of from about 0.5 percent by weight to about 20 percent by weight as internal additives, and from about 0.05 percent by weight to about 5 percent by weight as external additives.

111. A toner composition in accordance with claim 103 wherein the wax component has a number average molecular weight of about 700.

* * * * *